United States Patent [19]

Sibert

[11] Patent Number: 4,473,255

[45] Date of Patent: Sep. 25, 1984

[54] MAGNESIUM BICARBONATE AS AN IN SITU URANIUM LIXIVIANT

[75] Inventor: John W. Sibert, Venice, Calif.

[73] Assignee: Atlantic Richfield Company, Los Angeles, Calif.

[21] Appl. No.: 447,356

[22] Filed: Dec. 6, 1982

[51] Int. Cl.[3] ..... E21B 43/28

[52] U.S. Cl. ..... 299/5; 299/4; 423/17

[58] Field of Search ..... 299/4, 5; 423/17

[56] References Cited

U.S. PATENT DOCUMENTS 4,185,872 1/1980 Habib ..... 299/4

FOREIGN PATENT DOCUMENTS 517466 10/1955 Canada ..... 423/17
1117862 2/1982 Canada ..... 299/4
2757208 6/1978 Fed. Rep. of Germany ..... 423/17

*Primary Examiner*—Stephen J. Novosad
*Assistant Examiner*—Mark J. DelSignore
*Attorney, Agent, or Firm*—M. David Folzenlogen

[57] ABSTRACT

In the subsurface solution mining of mineral values, especially uranium, in situ, magnesium bicarbonate leaching solution is used instead of sodium, potassium and ammonium carbonate and bicarbonates. The magnesium bicarbonate solution is formed by combining carbon dioxide with magnesium oxide and water. The magnesium bicarbonate lixivant has four major advantages over prior art sodium, potassium and ammonium bicarbonates.

9 Claims, No Drawings

MAGNESIUM BICARBONATE AS AN IN SITU URANIUM LIXIVIANT

BACKGROUND OF THE INVENTION

This invention concerns the solution mining os uranium with novel lixiviant. The novel lixiviant is magnesium bicarbonate formed by combining carbon dioxide with magnesium oxide and water.

In known processes for leaching uranium values from underground formations in situ, an oxygenated aqueous solution of an alkaline or acid leaching agent is delivered to the uranium-bearing formation through one or more injection wells. Conventional alkaline leaching agents are sodium, potassium and ammonium carbonates and bicarbonates. The acid or alkaline leaching solution utilized in conjunction with the oxidant transforms the uranium mineral deposit into a soluble salt. The uranium mineral is leached from the formation, dissolved in the leaching solution and subsequently produced from an offsetting production well. The production fluid is then processed for the extraction of the uranium therefrom, with the spent leaching solution and oxidant being either reconstituted for reinjection into the formation or discarded.

Acid and alkaline leaching solutions, and sodium, potassium and ammonium carbonates or bicarbonates present distinct problems. Sodium and potassium cause clay swelling thereby affecting formation permeability and solution sweep efficiencies. Similar undesirable effects arise when sodium and potassium carbonate or bicarbonate cause calcite and gypsum precipitation. Acid leach solutions cause gypsum formation. Acid solutions react with certain formation minerals. Ammonium ions can cause adverse environmental effects which render it necessary to remove the ammonium ions after leaching. Alkaline solutions precipitate alkaline metal from the leach solution causing a decrease in injectivity, permeability and sweep efficiency. Continued injection of sodium, potassium and ammonium carbonates ot their respective bicarbonates in conjunction with oxidants results in a build up of these alkaline metal ions which aggrevates the forming of undesirable precipitates.

In the improved uranium leaching process of this invention, most of the problems associated with sodium, potassium and ammonium carbonates and bicarbonates are overcome or substantially reduced.

SUMMARY OF THE INVENTION

The objects of this invention are accomplished using magnesium bicarbonate solution to replace sodium, potassium and ammonium carbonates and bicarbonates. The magnesium bicarbonate solution is formed by combining carbon dioxide with magnesium oxide and water. The magnesium bicarbonate lixiviant composition has at least four significant advantages. The pH of the solution may be maintained at approximately 7 thus minimizing calcite formation and the other adverse effects of acid or alkaline solutions. In addition, magnesium ions tend to shrink clays thereby enhancing permeability rather than reducing it. Magnesium ions eliminate the environmental necessity of removing ammonium ions after leaching. Divalent magnesium ions form an uncharged complex with sulfate thereby reducing gysum precipitation. Magnesium bicarbonate does not exist except in solution; therefore, the solution of magnesium bicarbonate will usually be formed on site. The magnesium bicarbonate solution is used in the same fashion as sodium, potassium and ammonium carbonate and bicarbonate solutions are used in known uranium in situ leaching processes.

DETAILED DESCRIPTION OF THE INVENTION

Uranium values or minerals and other oxidizeable, leachable substances like thorium, vanadium, copper, nickel, molybdenum, rhenium and selenium frequently occur in underground or subterranean siliceous rocks and sedimentary deposits or formations. Uranium generally occurs as a mixture of the insoluble tetravalent form and the soluble hexavalent form. In the basic solution mining process of this invention, an oxidant or oxidizing agent in injected or introduced into a subterranean deposit to contact the mineral substance and to oxidize the mineral in place to a soluble form. Air is usually used as the oxidizing agent, but oxygen and hydrogen peroxide are also suitable oxidizing agents. Other chemical oxidants like permanganates may be used, but the cost of such chemicals and the difficulty or removing them from some formations render such chemicals economically unattractive. The preferred concentration of oxidizing agent on a free oxygen basis is between 25 and 250 parts per million.

The oxidized mineral substance, e.g., hexavalent uranium, is contacted in situ by injecting magnesium bicarbonate leaching solution into the formation to solubilize the hexavalent uranium and form a pregnant liquor of the mineral. This pregnant liquor is recovered or extracted from the mineral deposit. The oxidation of the mineral can be carried out as a separate step or simultaneously with the magnesium bicarbonate leaching step. Preferably, however, the process is operated continuously and the oxidizing agent and leaching solution are injected simultaneously.

Since magnesium bicarbonate does not exist except in water in the presence of some free carbon dioxide, the magnesium bicarbonate solution injected into the formation formed by combining carbon dioxide and water with magnesium oxide or magnesium carbonate, for example, the carbon dioxide may be bubbled through a water-magnesium oxide mixture under pressure. Preferably, the magnesium bicarbonate leach solution is formed at the injection site just prior to the injection. Preferably, the pH of the leach solution is maintained between 6 and 8 and is kept as close to 7 as is feasible. The maximum concentration of magnesium bicarbonate depends on the type of water used to form the leach solution, the ratio of the volume of the solution injected to the volume of the liquid produced, and other factors well understood by those skilled in the art. Preferably, the bicarbonate ion concentration will be between 250 and 1500 parts per million.

In a conventional fashion, the magnesium bicarbonate leaching solution is brought into contact with the subterranean deposit through one or more injection wells which penetrate the subterranean deposit. The leaching solution is introduced into an injection well under sufficient pressure to force it out into the adjacent deposit. Continued injection of the magnesium bicarbonate leaching solution drives pregnant solution through the deposit to one or more spaced-apart production wells where the solution is recovered for subsequent extraction of the mineral values. The leaching solution may also be driven by a follow-up drive fluid. The drive fluid may be air, water, flue gas, brine or any other suitable fluid for displacing the leaching solution.

The number of injection and production wells and the spacing therebetween can be varied to best suit the nature of the formation. It is preferred that the injection and production wells either be drilled in concentric patterns about each other with a single production well contained within the center of the pattern, for example a typical five-spot pattern, or that the injection and production wells be drilled in offsetting line patterns so as to create a line drive sweep mechanism within the uranium formation. Generally, the distance between the injection and production wells will be from 20 to 500 feet. Particular engineering conditions of the formation such as depth, thickness, permeability, porosity, water saturation, and economic and recoverable value of the uranium mineral in the formation control the design of the well pattern for a specific formation.

Alternatively, a given volume of leaching solution can be injected into a well to percolate into the surrounding formation. Following this injection phase, the injected leaching solution may be recovered from the same well into which it had been injected. If desired, one or more of the production wells may be turned into an injection well. Also each stage or variation of the process may be followed or preceded by one or more periods of noninjection with or without continued production. Also, each stage or variation of the process may be followed or preceded by one or more periods of nonproduction with or without continued injection. Therefore, through patterned well completion and other variations of the type mentioned, the process may be used sequentially across the deposit so that the entire deposit is treated.

The process of this disclosure may be preceded by one or more buffer zones to improve or control sweep patterns or to remove deleterious substances. Moreover, surface active agents, clay swelling inhibitors, solubility improvers, and other additives used in subsurface formations for improved results may be used.

The pregnant mineral enriched solution that enters a production well is recovered by conveyance to the surface. At the surface, the recovered pregnant solution is processed in any desired way to recover the mineral value. For example, the pregnant solution may be filtered and passed through an ion exchange resin. The resin is then treated with sodium chloride solution with or without added carbon dioxide or the like. The recovered mineral may then be further prepared for commercial use if desired.

It is possible in the above described manner to lixivate uranium from any strata containing extractible values with the magnesium bicarbonate solution, including granites and granitic deposits, pegmatites and pegmatitic dikes and other formations and sedimentary deposits including sandstones, oil sands, etc., and uranium deposits of secondary character where for example the mineral values leached from say, pegmatitic sources have been naturally redeposited in some conveniently located porous sedimentary stratum.

The above indicated solution mining processes for recovering mineral values, especially uranium, from a subsurface formation with magnesium bicarbonate leach solution an illustration of the wide variety of available procedures for in situ solution mining of recoverable minerals like uranium. This invention is not concerned especially with the provision of any particular method for mining the mineral from a subsurface formation. Any convenient or desirable method may be employed for this purpose so long as it includes the basic steps of injecting an oxidant, injecting a magnesium bicarbonate leach solution, recovering a mineral pregnant liquor, and recovering the mineral from the pregnant liquor. It is the magnesium bicarbonate that provides the aforementioned advantages of this process over prior processes of this nature.

I claim:

1. In a method for the solution mining of a substance from an underground formation wherein an oxidant and an aqueous leaching solution are introduced to solubilize said substance to form a pregnant liquor of said substance and pregnant liquor is recovered from the underground formation, the improvement comprising utilizing as said aqueous leaching solution a solution comprising magnesium bicarbonate, said magnesium bicarbonate solution being formed by combining carbon dioxide with magnesium oxide and water.

2. The method of claim 1 wherein the substance solution mined from the underground formation is predominantly uranium.

3. The method of claim 1 wherein the pH of the magnesium bicarbonate solution is between 6 and 8.

4. The method of claim 1 wherein the concentration of bicarbonate in the magnesium bicarbonate before introduction into the underground formation is between 250 and 1500 parts per million.

5. A method for recovering uranium from a subterranean deposit comprising:

(a) injecting an oxidizing agent into said deposit to oxidize uranium values in said deposit;

(b) injecting an aqueous solution of magnesium bicarbonate into said deposit to leach in situ uranium values from said deposit and form a pregnant liquor, said magnesium bicarbonate leach solution being formed by combining carbon dioxide with magnesium oxide and water, (c) recovering said pregnant liquor from deposit; and (d) recovering at the earth's surface uranium from said pregnant liquor.

6. The method of claim 5 wherein the pH of the magnesium bicarbonate solution is between 6 and 8.

7. The method of claim 5 wherein the concentration of bicarbonate in the magnesium bicarbonate leach solution before injection is said deposit is between 250 and 1500 parts per million.

8. The method of claim 5 wherein the oxidizing agent is comprised of free oxygen and the concentration of free oxygen is between 25 and 250 parts per million.

9. The method of claim 5 wherein the oxidizing agent and magnesium bicarbonate solution are injected simultaneously into the deposit.

* * * * *